US006488811B1

(12) United States Patent
Dong

(10) Patent No.: US 6,488,811 B1
(45) Date of Patent: Dec. 3, 2002

(54) MULTICOMPONENT MATS OF GLASS FIBERS AND NATURAL FIBERS AND THEIR METHOD OF MANUFACTURE

(75) Inventor: Daojie Dong, Westerville, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/845,970

(22) Filed: Apr. 30, 2001

(51) Int. Cl.[7] ..... D21H 13/40

(52) U.S. Cl. ..... 162/145; 162/148; 162/149; 162/171

(58) Field of Search ..... 162/91, 99, 141, 162/142, 145, 156, 148, 149, 171; 428/141

(56) References Cited

U.S. PATENT DOCUMENTS

| | | | | |
|---|---|---|---|---|
| 3,012,929 A | | 12/1961 | Jackson | |
| 3,135,590 A | | 6/1964 | Campbell et al. | |
| 3,749,638 A | | 7/1973 | Renaud et al. | |
| 4,160,159 A | | 7/1979 | Kakukawa et al. | |
| 4,234,379 A | * | 11/1980 | Conway et al. | 162/156 |
| 4,472,243 A | | 9/1984 | Bondoc et al. | |
| 4,609,431 A | | 9/1986 | Grose et al. | |
| 4,971,742 A | | 11/1990 | Brooks et al. | |
| 5,167,765 A | | 12/1992 | Nielsen et al. | |
| 5,393,379 A | | 2/1995 | Parrinello | |
| 5,407,536 A | * | 4/1995 | Razac et al. | 162/156 |
| 5,580,459 A | | 12/1996 | Powers et al. | |
| 5,614,096 A | | 3/1997 | Cohen et al. | |
| 5,837,627 A | | 11/1998 | Halabisky et al. | |
| 5,853,538 A | | 12/1998 | Reiner | |
| 5,873,150 A | | 2/1999 | Gerard | |
| 5,965,638 A | | 10/1999 | Heine | |
| 6,146,705 A | | 11/2000 | Heine | |

FOREIGN PATENT DOCUMENTS

| | | |
|---|---|---|
| EP | 00004833 | 10/1979 |
| EP | 0070164 | 1/1983 |
| EP | 0311860 | 4/1989 |
| EP | 0 459 519 | 12/1991 |
| GB | 723 955 | 2/1955 |
| GB | 753 485 | 7/1956 |
| WO | WO 88/01319 | 2/1988 |
| WO | WO 98/11299 | 3/1998 |
| WO | WO 98 31626 | 7/1998 |
| WO | WO 99/13154 | 3/1999 |

OTHER PUBLICATIONS

U.S. patent application Ser. No. 09/474,449, Dong, pending application.

U.S. patent application Ser. No. 60/147,256, Dong, abandoned application.

* cited by examiner

*Primary Examiner*—Peter Chin
(74) *Attorney, Agent, or Firm*—Inger H. Eckert; James J. Dottavio

(57) ABSTRACT

The invention relates to a method of forming a multicomponent mat, the multicomponent mat which is formed from glass fibers and natural fibers and methods of making a multicomponent mat. Initially in the method of forming a multicomponent mat, a natural fiber slurry is formed. The next step involves using a surfactant to disperse glass fibers in white water. The natural fiber slurry and the slurry of glass fibers are generally compatible and are combined to form a multicomponent slurry which is used to form a multicomponent mat.

23 Claims, 9 Drawing Sheets

MULTICOMPONENT MATS OF GLASS FIBERS AND NATURAL FIBERS AND THEIR METHOD OF MANUFACTURE

TECHNICAL FIELD AND INDUSTRIAL APPLICABILITY OF THE INVENTION

This invention relates generally to multicomponent mats and their method of manufacture. In particular, the invention relates to a method of making a multi-component mat of glass fibers and natural fibers using a natural fiber slurry and a glass fiber slurry and the mats formed by this method.

BACKGROUND OF THE INVENTION

U.S. Pat. Nos. 5,965,638 and 6,146,705 disclose structural mat matrices comprising a substrate consisting essentially from 80% to 99% by weight fiberglass fibers, from 20% to 1% by weight wood pulp and from 5% to 15% by weight binder.

A method for making a bicomponent mat of glass fibers and pulp fibers is disclosed in my copending application, U.S. Ser. No. 09/474,449, the disclosure of which is incorporated herein by reference. The mat is formed from pulp and glass fibers. The pulp fibers have a length of from about 0.05 inch to about 0.2 inch.

It would be desirable to form mats having natural fibers with lengths that exceed the lengths of pulp fibers so as to enhance the strength characteristics of the final mat.

SUMMARY OF THE INVENTION

Generally, the multicomponent mat of the present invention is formed from glass fibers and natural fibers. The process involves forming a natural fiber slurry comprising natural fibers having a length between about 0.2 inch (5 mm) and about 2.0 inches (51 mm) and water. The natural fiber slurry may include a cationic polymer. The next step involves dispersing glass fibers in, for example, a white water. The natural fiber slurry and the glass fiber slurry are compatible with one another and are combined to form a multicomponent furnish or slurry.

The mats of the present invention have several advantages. First, they contain natural fibers which can be easily burned during a disposal process once the useful life of a final product in which a mat is incorporated has ended or can be easily recycled. Second, the mats have high strength characteristics, especially high tear strength. The mats of the present invention may be incorporated into such products as shingles and automotive headliners.

The method of this invention involves making a multicomponent mat of glass fibers and natural fibers comprising the steps of: forming a natural fiber slurry by mixing natural fibers and water, a cationic polymer may or may not be added; forming a slurry of glass fibers by mixing together a dispersant, water, glass fibers, and a viscosity modifier; combining and mixing the natural fiber slurry and the slurry of glass fibers to form a wet mat; and removing any excess moisture. A binder may also be applied to the wet mat. If applied, the binder may be cured during the moisture removal step.

DETAILED DESCRIPTION AND PREFERRED EMBODIMENTS OF THE INVENTION

Figure 1:
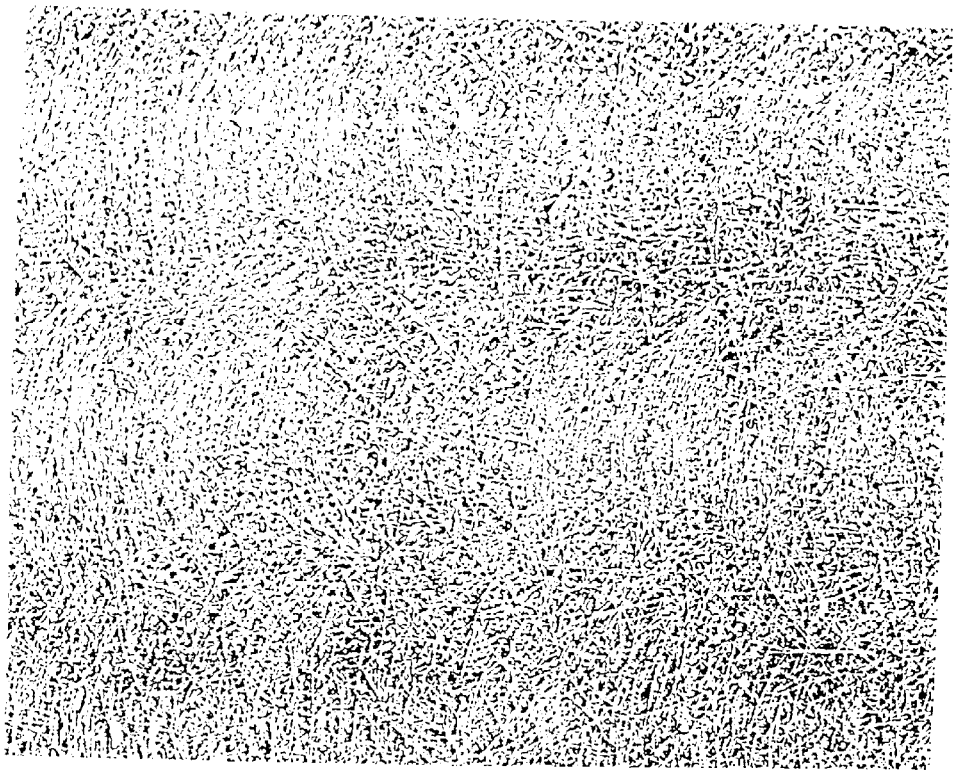
FIG. 1 is a photocopy of a mat produced in Example 1.
Figure 2:
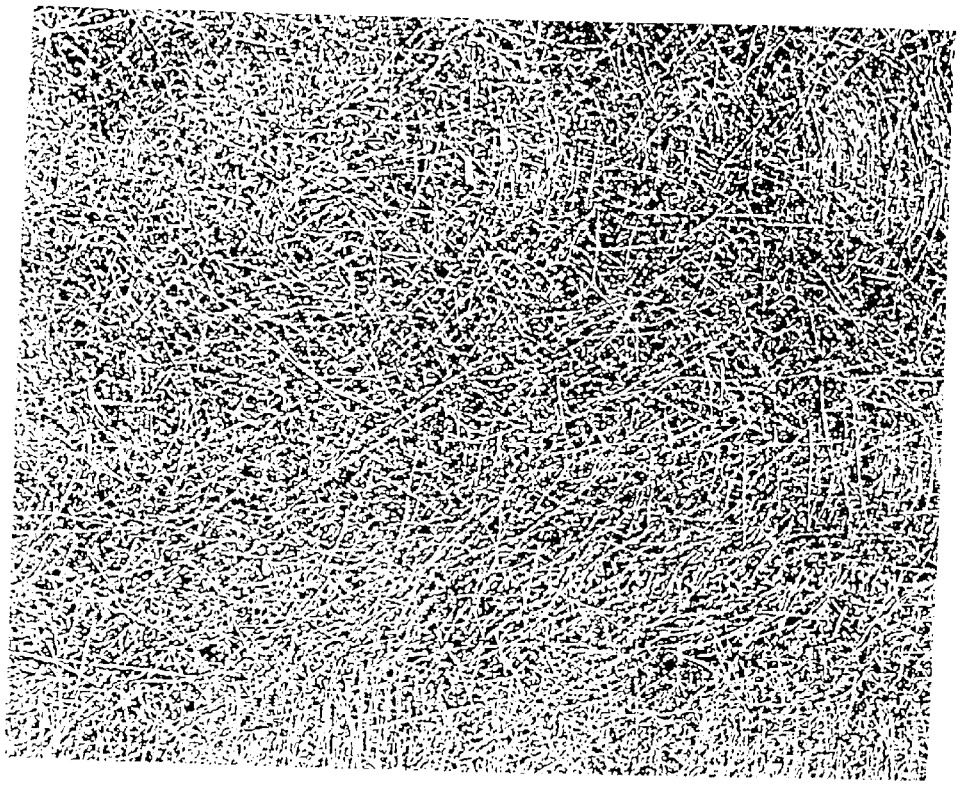
FIG. 2 is a photocopy of a mat produced in Example 2.
Figure 3:
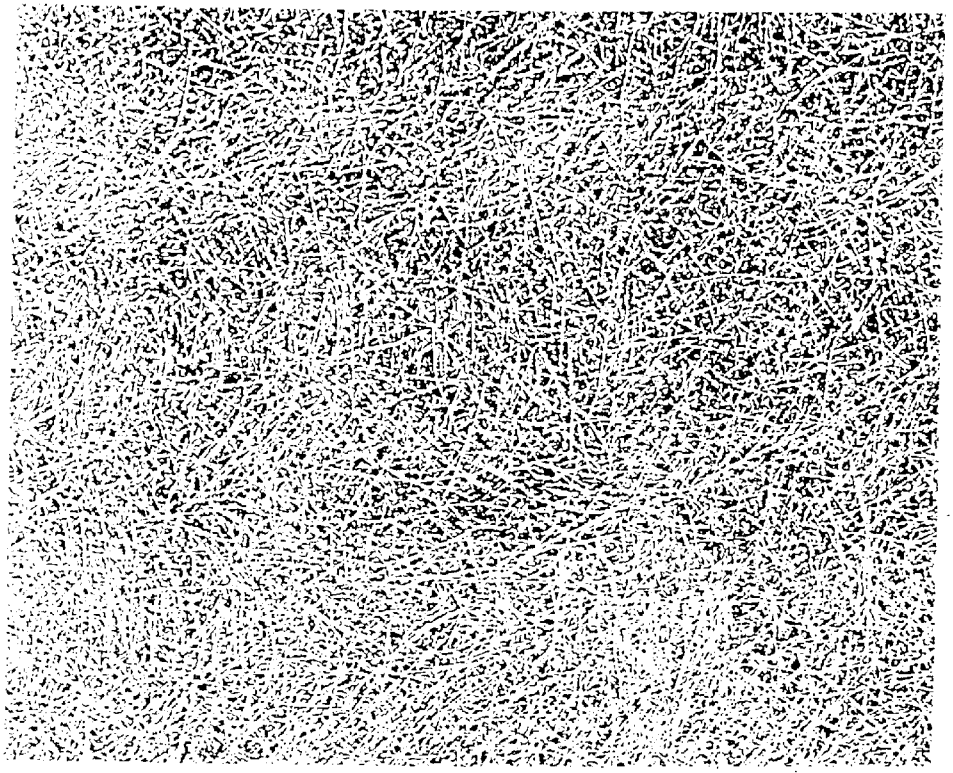
FIG. 3 is a photocopy of a mat produced in Example 3.
Figure 4:
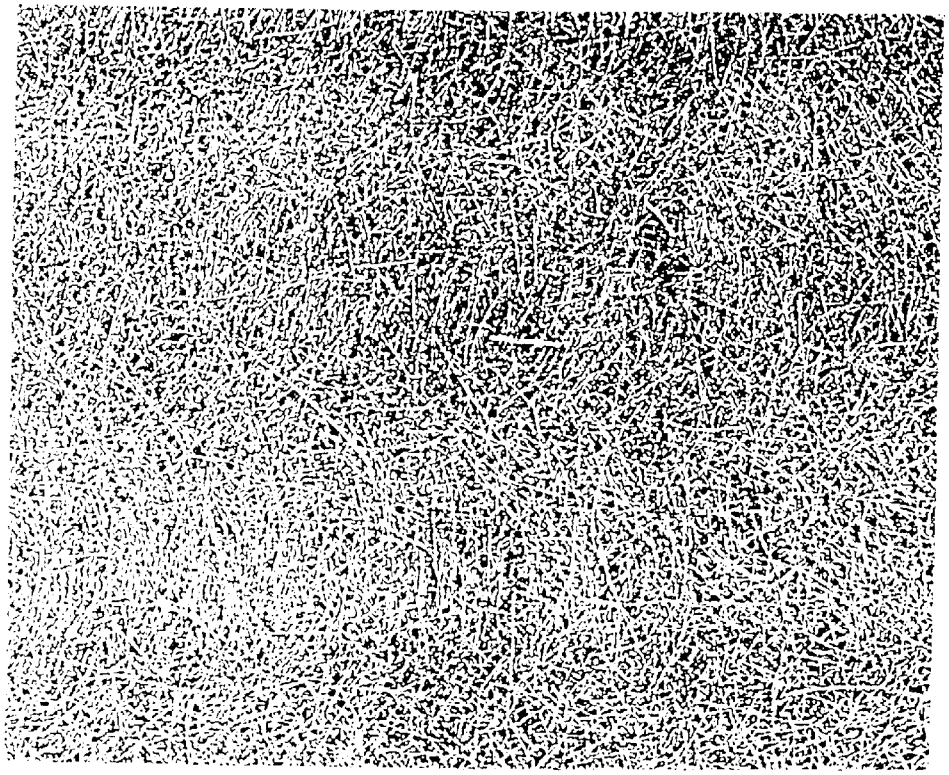
FIG. 4 is a photocopy of a mat produced in Example 4.
Figure 5:
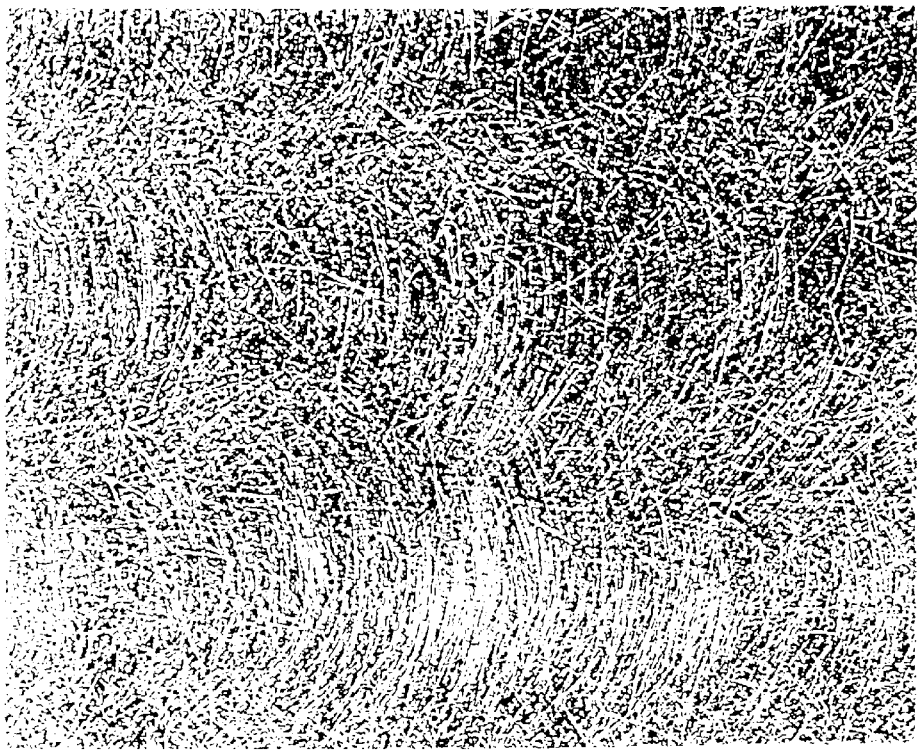
FIG. 5 is a photocopy of a mat produced in Example 5.
Figure 6:
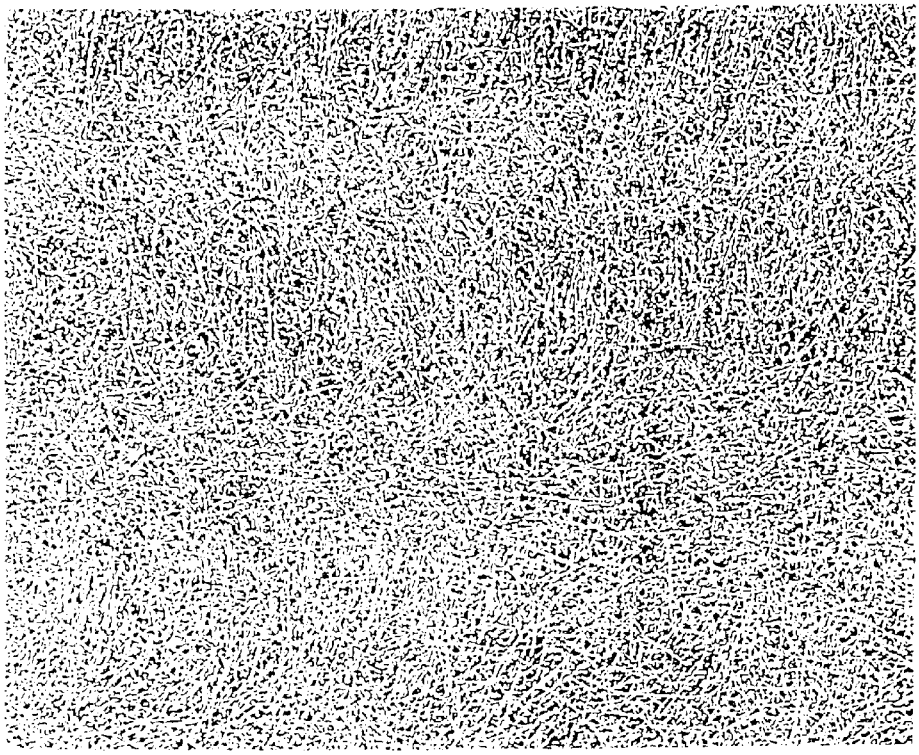
FIG. 6 is a photocopy of a mat produced in Example 6.
Figure 7:
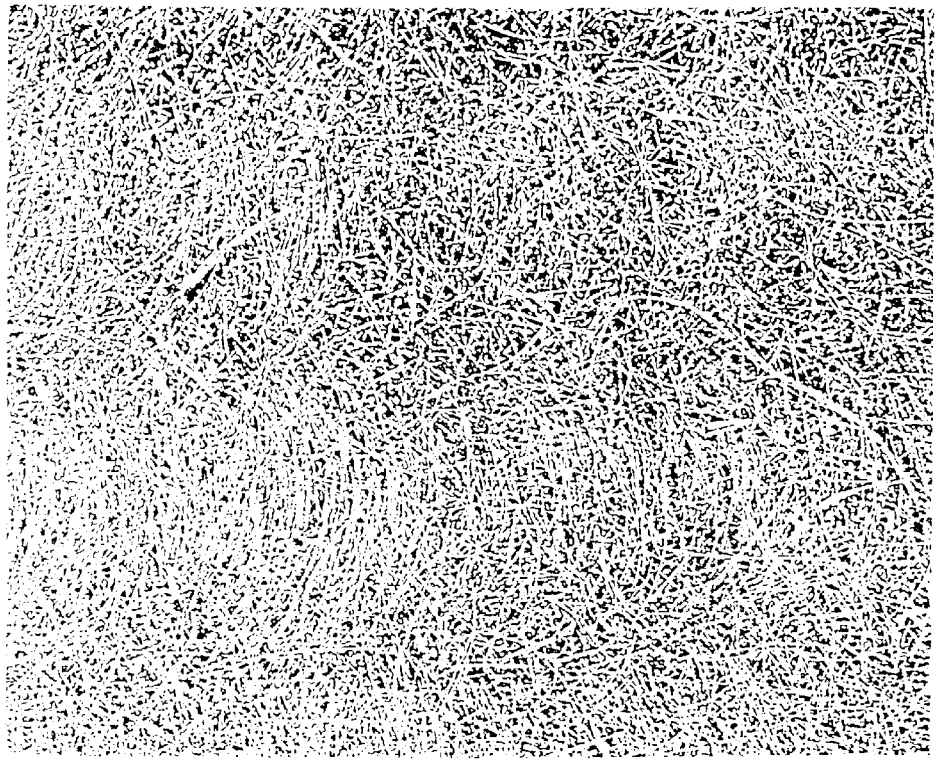
FIG. 7 is a photocopy of a mat produced in Example 7.
Figure 8:
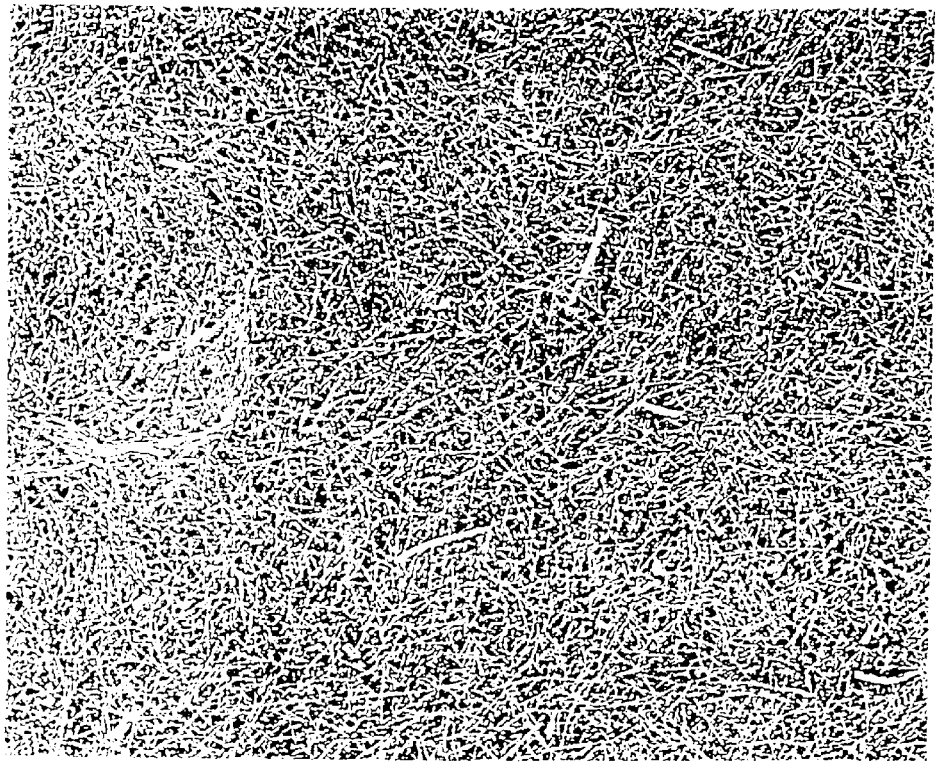
FIG. 8 is a photocopy of a mat produced in Example 8.
Figure 9:
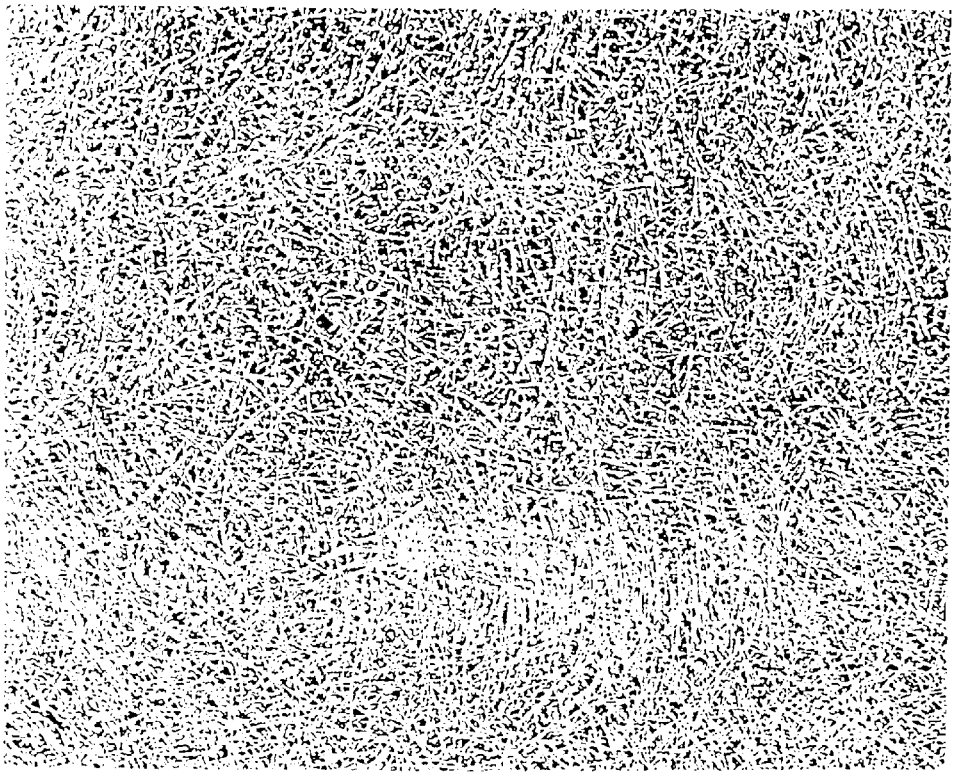
FIG. 9 is a photocopy of a mat produced in Example 9.
Figure 10:
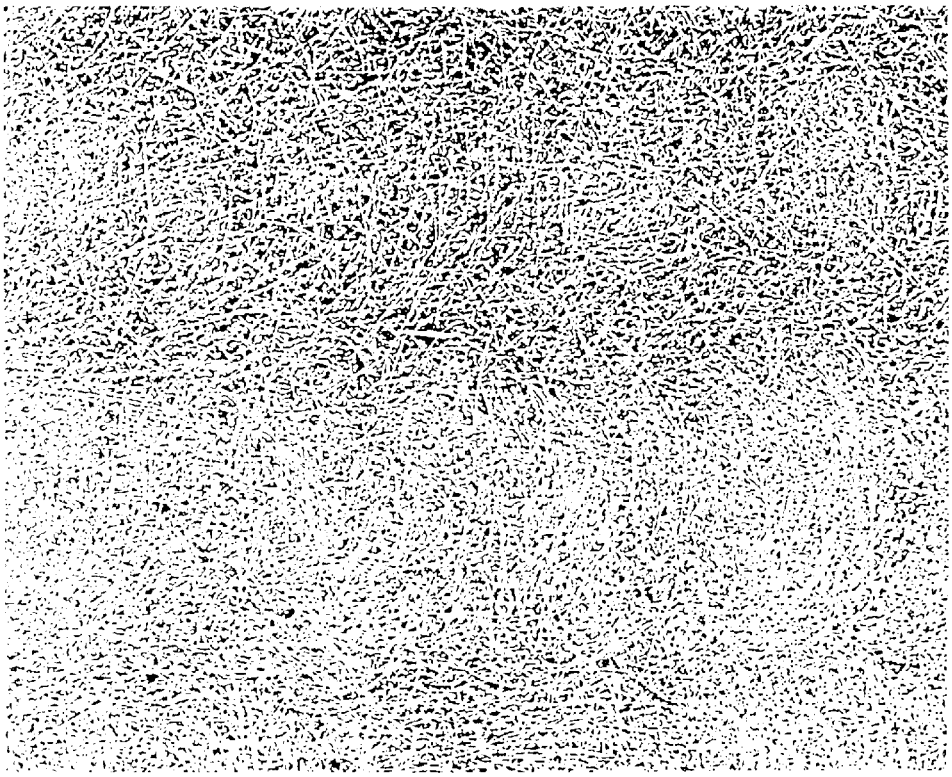
FIG. 10 is a photocopy of a mat produced in Example 10.
Figure 11:
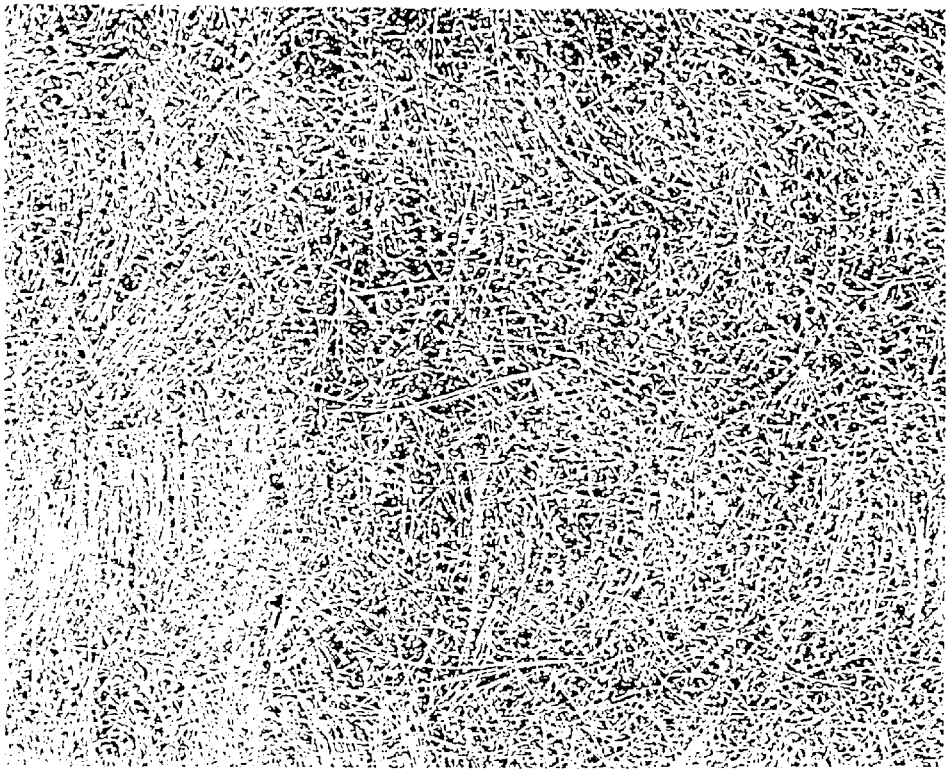
FIG. 11 is a photocopy of a mat produced in Example 11.
Figure 12:
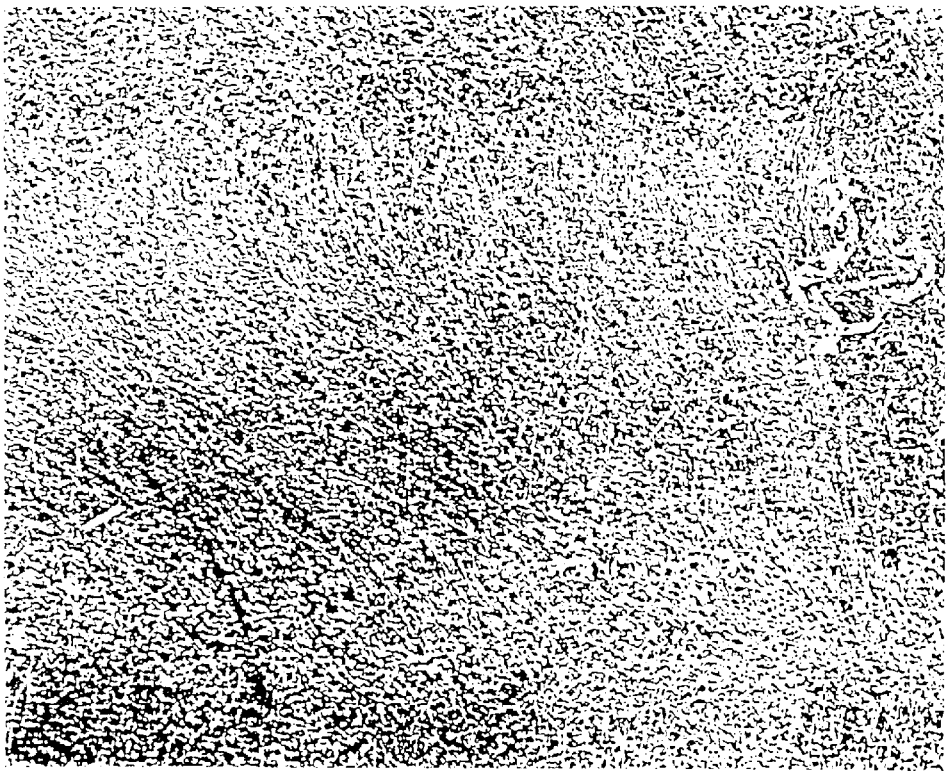
FIG. 12 is a photocopy of a mat produced in Example 12.

A multicomponent mat and method of forming such a mat is described in detail below. Through the method of the invention improved multicomponent mats may be formed which exhibit advantageous properties as compared to conventional multicomponent mats. The mats of the present invention preferably are formed from natural fibers having a length between about 0.2 inch (5 mm) to about 2.0 inches (51 mm), preferably in the range of about 0.25 inch (6.4 mm) to about 1.25 inch (31.8 mm), most preferably in the range of about 0.5 inch (12.7 mm) to about 1.0 inch (25.4 mm), as well as all other ranges subsumed within the range of 0.2 inch (5 mm) to about 2.0 inches (51 mm). Due to the length of the natural fibers, the mats of the invention are capable of exhibiting improved mechanical strength, tear resistance, and tensile strength. The mats of the invention may be in the form of a uniform web which may be coated with a binder composition depending upon the desired use.

An objective of the disclosed method is to provide an improved wet process method for making multicomponent mats of glass fibers and natural fibers. The multicomponent mat may be formed by handsheeting or pilot/commercial scale wet laid processes. A wet laid process is advantageous for forming a generally uniform web, and is particularly advantageous for obtaining a generally uniform dispersion of fibers of different diameters.

The preferred article of the invention is a multicomponent mat. The method of this invention involves making a multicomponent mat of glass fibers and natural fibers comprising the steps of: forming a natural fiber slurry by mixing together natural fibers and water, a cationic polymer may or may not be provided; forming a slurry of glass fibers by mixing together a dispersant, water, glass fibers, and a viscosity modifier; combining and mixing the natural fiber slurry and the slurry of glass fibers to form a wet mat; and removing any excess moisture. A binder may be applied to the wet mat. If so, the binder may be cured during the moisture removal process.

The mat generally comprises two components: glass fibers and natural fibers. An organic binder may also be provided. In the finished mat, the glass fibers are present in the range of about 10% to about 90% by weight. The natural fibers are present in the range of about 90% to about 10% by weight. The organic binder is present in the range of about 0% to about 30% by weight, and preferably in the range of about 5% to about 15%. Typically, the mats of the invention will contain small amounts of a dispersant, such as a surfactant. It is preferred that the mat contains less than about 1% by weight of surfactant. The mat may have a thickness of from about 0.010 inch to about 0.050 inch, and preferably from about 0.015 inch to about 0.030 inch.

The invention involves the combination of a natural fiber slurry and a glass fiber slurry. The first component of the disclosed method comprises the natural fiber slurry. The preferred natural fibers are kenaf fibers, sisal fibers, flax and hemp. Kenaf fibers are commercially available from Kenaf Industries of Raymondville, Tex. Commercially available kenaf fibers will typically contain a small percentage of core and skin components. It is preferred that such core and skin components comprise less than 1% by weight of the kenaf fibers. Other natural fibers having a length between about 0.2 inch (5 mm) and about 2.0 inches (51 mm) may also be used.

One or two or more types of natural fibers may be employed in making a given mat. For example, kenaf and sisal fibers, with or without other natural fibers, may be employed. Alternatively, only kenaf fibers or only sisal fibers may be used.

If the quality of the natural fibers is poor, i.e., they contain an unacceptable amount (e.g., greater than 1% by weight of the fibers) of core and skin components, then the fibers may undergo a pretreatment process. Four such processes are discussed in the Examples set out below. If such a pretreatment process is deemed not necessary, the fibers will not be presoaked in water.

The natural fibers of any moisture content are initially added to water and subsequently agitated by a conventional blender or mixer to form a slurry. The weight percentage of fibers in the water is not particularly limited, so long as the fibers may be dispersed in the water. For example, the natural fibers may comprise between 2.0% and 20% by weight of the slurry, and preferably about 7.0% to about 14% by weight of the slurry. A cationic polymer may be added to treat the natural fiber slurry should the natural fibers tend to flocculate or form clumps. With many natural fibers, such a polymer is not required. If a cationic polymer is used, the preferred cationic polymer is Nalco 7530, which is an acrylamide modified cationic copolymer available from Nalco Chemical Company, Naperville, Ill. The skilled artisan will appreciate that several types of cationic polymers may be used. When used, the weight percentage of cationic polymer added to the natural fiber slurry may depend on the amount of natural fibers used, the composition, charge density, and molecular weight of the polymer used, as well as the size and type of container (e.g. stainless steel or plastic) used in the process. Generally, the polymer may comprise between 0% and 1.0% by weight of the slurry, and preferably about 0.0% to about 0.5% by weight of the slurry.

The term "white water" refers to an aqueous solution which may contain numerous dispersants, thickeners, softening chemicals, hardening chemicals, or dispersed or emulsified thermoplastic polymers. The term "white water slurry" refers to an aqueous solution comprising fibers dispersed in white water.

The glass fiber slurry preferably comprises a generally uniform dispersion of the glass fibers in a water carrier medium or white water. For example, the white water may comprise a system of water, a dispersing agent (dispersant), and a viscosity modifier. A viscosity modifier that increases the viscosity of the water carrier medium will generally be selected and is referred to as a thickener. A dispersant that beneficially aids fiber interaction with the water carrier medium to assist in dispersion of the separate fibers and acts to wet out the surface of the fibers, is typically chosen. Also, pH adjustment of the water carrier medium may be advantageous depending on the types of fibers. In addition, it may be advisable in some cases to use a suitable anti-foaming agent or other processing aids well known to those skilled in the art.

Various ingredients may be used as the viscosity modifier and dispersant, and it is not so important which additives are chosen, but rather that a generally uniform dispersion of fibers in the white water is produced. Also, the white water slurry will advantageously be sufficiently stable that a web laid from the white water slurry is generally uniform and free of aggregated or clumped fibers.

According to the invention, a dispersant is added initially to water. The dispersant is a surfactant that helps break bundles and disperse glass filaments and natural fibers. The surfactant assists in releasing the sizing agent typically present in commercially available glass fibers. Selection will be based upon compatibility with the different fiber components and with other processing aids. The surfactant may be a cationic or amphoteric surfactant. The preferred dispersants for the invention are, for example, a cocamidopropyl hydroxysultaine, which is commercially available from Rhone-Poulenc, under the product designation "Mirataine CBS," and ethoxylated amine, which is commercially available from Rhone-Poulenc, under the product designation "Rhodameen VP-532/SPB. Another preferred dispersant includes an ethoxylated amine, which is commercially available from Nalco Chemical Co. under the product designation "Nalco 8493." The dispersants may be deposited on and coat the glass and natural fiber surfaces. This coating action may aid in deterring the formation of clumps, tangles and bundles. This surfactant makes the natural fiber slurry and the white water slurry compatible with each other.

The concentration of the dispersant in the white water slurry may be varied within relatively wide limits and may be as low as 50 ppm of the white water slurry and up to as high as about 300 ppm. Higher concentrations up to about 500 ppm may be used but may be uneconomical and cause low wet web strength. Thus, it is preferred that the amount of the dispersant ranges from preferably, about 50 ppm up to about 200 ppm.

It is believed that by adding the dispersant to an aqueous medium first allows the glass fibers to enter a favorable aqueous environment containing the dispersant which is immediately conducive to their maintaining their individuality with respect to each other whereby there is substantially no tendency to flocculate or form clumps, tangles or bundles. By employing the dispersing agents of the invention, the glass fibers are dispersed to arrive at the conditions of nonflocculation.

After the dispersant is added to the aqueous mixture, glass fibers are added. The glass fibers are chosen from the group consisting of glass fibers, rock wool and other suitable mineral fibers. Of these fibers, the preferred material is chopped glass fibers such as fibers commercially available from Owens Corning, Toledo, Ohio, sold under the product designations "OC 9502 Wet Use Chopped Strands," "OC 776B Wet Use Chopped Strands," and "OC 9501 Wet Use Chopped Strands." Glass fibers do not absorb any moisture, have high tensile strengths, very high densities and excellent dimensional stability. The glass fibers suitable for use in the invention have average lengths of from about 0.1 inch to 1.5 inch, preferably 0.75 inch to 1.25 inch and have an average diameter in the range of 5 to 30 microns, preferably 10 to 20 microns, and most preferably, 11 to 16 microns. These commercially available fibers are characteristically sized. Sizes are commonly employed by manufacturers of glass fibers and the release of the sizing composition by a cationic antistatic agent eliminates fiber agglomeration and permits a uniform dispersion of the glass fibers upon agitation of the dispersion in the tank. The typical amount of glass fibers for effective dispersion in the glass slurry (a thick stock) is within the range of 0.1 percent to about 3.0 percent, and most preferably about 1 percent, by weight of the dispersion or white water slurry. Thereafter, the white water slurry or thick stock is diluted and prior to forming the mat, the amount of glass fibers is between about 0.01% and 0.1%, preferably, about 0.02% to about 0.06%, and most preferably, about 0.03% to about 0.05% by weight of the white water slurry.

After the glass fibers have been added and mixed, a viscosity modifier is added to the aqueous solution. The viscosity modifier acts to increase the viscosity of the water carrier medium and also acts as a lubricant for the fibers. Through these actions, the viscosity modifier acts to combat flocculation of the fibers. The concentration of the viscosity modifier in the white water slurry may likewise be varied within relatively wide limits. Concentrations may be from about 50 ppm to about 1,000 ppm of the white water slurry, or in some cases as much as about 1%.

Any viscosity modifier that achieves a viscosity in the range of 1.5 to 6.0 centipoise in the white water slurry may be used. Preferably, the viscosity modifier may achieve a viscosity in the range of 2.0 to 4.0 centipoise, and most preferably, in the range of 3.0 to 3.5. Useful viscosity modifiers also include synthetic, long chain, linear molecules having an extremely high molecular weight, on the order of at least about 1 million and up to about 15 million, or 20 million, or even higher. Preferably, molecules with a molecular weight of 16 million are used. Examples of such viscosity modifiers are polyethylene oxide which is a long chain, nonionic homopolymer and has an average molecular weight of from about 1 to 7 million or higher; polyacrylamide which is a long, straight chain, nonionic or slightly anionic homopolymer and has an average molecular weight of from about 1 million up to about 15 million or higher; acrylamide-acrylic acid copolymers which are long, straight chain, anionic polyelectrolytes in neutral and alkaline solutions, but nonionic under acid conditions, and possess an average molecular weight in the range of about 2 to 3 million, or higher; and polyamines which are long, straight chain, cationic polyelectrolytes and have a high molecular weight of from about 1 to 5 million or higher. The preferred viscosity modifiers include modified polyacrylamides available from Nalco Chemical Company, such as Nalco 2824 and Nalco 7768.

Other useful viscosity modifiers include nonionic associative thickeners, for example, relatively low (10,000–200,000) molecular weight, ethylene oxide-based, urethane block copolymers. These associative viscosity modifiers are particularly effective when the fiber slurry contains 10% or more staple length hydrophobic fibers. Commercial formulations of these copolymers are sold by Rohm and Haas, Philadelphia, Pa., under the trade names ACRYSOL RM-825 and ACRYSOL RHEOLOGY MODIFIER QR-708, QR-735, and QR-1001 which comprise urethane block copolymers in carrier fluids. ACRYSOL RM-825 is 25% solids grade of polymer in a mixture of 25% butyl carbitol (a diethylene glycol monobutylether) and 75% water, and ACRYSOL RHEOLOGY MODIFIER QR-708, a 35% solids grade in a mixture of 60% propylene glycol and 40% water can also be used. Similar copolymers in this class, including those marketed by Union Carbide Corporation, Danbury, Conn. under the trade names SCT-200 and SCT-275 and by Hi-Tek Polymers under the trade name SCN 11909 are useful in the process of this invention.

Another class of suitable viscosity modifiers, preferred for making up fiber furnishes containing predominantly cellulose fibers, e.g. rayon fibers or a blend of wood fibers and synthetic cellulosic fibers such as rayon, comprises the modified nonionic cellulose ethers of the type disclosed in U.S. Pat. No. 4,228,277 incorporated herein by reference in its entirety. Such cellulosic ethers are sold under the trade name AQUALON by Hercules Inc., Wilmington, Del. AQUALON WSP M-1017, and include a hydroxy ethyl cellulose modified with a C-10 to C-24 side chain alkyl group and having a molecular weight in the range of 50,000 to 400,000 that may be used in the whitewater system.

Other viscosity modifiers suitable for use in the invention are available under the trade designations Hyperfloc CP 905 L, Hyperflock CE 193, Hyperfloc AE 847, and Hyperflock AF 307, all commercially available from Hychem, Inc., Tampa, Fla.; Superfloc MX 60, Magrifloc 1885 A, Superflock A 1885 and Cytec AF124, commercially available from Cytec Industries, West Paterson, N.J., and Jayflock 3455 L, commercially available from Callaway Chemical Company, Columbus, Ga.

A conventional defoamer may be used in the white water to prevent the buildup of foam during the forming process.

After the glass fiber slurry is formed, it is combined with the natural fiber slurry to formn a thick stock or furnish. The thick stock is then diluted by combining between about 15 to about 30 parts white water with about 1 part thick stock. The diluted thick stock is referred to as a thin stock. The thin stock is then placed on a screen in a known manner and precipitated into a nonwoven, sheet-like mat by the removal of water, usually by a suction and/or vacuum device to form a wet mat. In the wet mat, natural fibers are present in an amount of about 90 to about 10 weight % of total solids, the glass fibers are present in an amount of about 10 to about 90 weight % of total solids, and the dispersant is present in the wet mat in an amount of about 1 weight % or less of total solids. The mat is dried at a temperature to remove the moisture.

A mat binder, such as any conventional thermoplastic or thermoset binder, may be applied to the wet mat. Suitable binders include poly(vinyl alcohol), poly(vinyl acetate), carboxymethyl cellulose and starch, SBR modified urea formaldehyde (UF) resin, and styrene butadiene latex. The binder is present in the wet mat in an amount of about 0 to about 30 weight percent of total solids and preferably from about 5% to about 15%.

Having applied a binder to the mat, the drying and curing of the mat may be done by any well-known means of drying water in the mat and heating it. For example, the mat may be heat cured. One known drying machine is a Honeycomb System Through-Air Dryer. The heating temperature may be from 190° C. to 260° C. It is to be appreciated that too high a temperature will damage the multicomponent mat and too low a temperature will either result in a curing time that is too excessive (if a thermoset binder is used) or inadequate melting of a thermoplastic binding composition (if a thermoplastic binder is used).

An example of a suitable heating process includes passing the mat through a drying machine in which the mat is dried and the resin is cured, e.g. thermoset or chemically bonded. Generally the resin may be a modified UF resin with SBR.

When drying and bonding the mat having a thermoplastic binder, the melting temperature of the thermoplastic binder may vary. Selection of a relatively higher drier temperature generally requires a relatively shorter exposure time, whereas selection of a relatively lower drier temperature usually requires a relatively longer exposure time.

The multicomponent mats of the invention may be made using conventional equipment in a batch, semi-batch, or a continuous process. For example, in a small batch process, the multicomponent mat may be formed by draining off water from the furnish by use of a deckle box, and the multicomponent fibers may be caught on the top of the screen of the deckle box. The wet multicomponent fiber mat may be dried to form a handsheet.

For a commercial scale process, the multicomponent mats of the invention are generally processed through the use of papermaking-type machines such as commercially available Fourdrinier, wire cylinder, Stevens Former, Roto Former, Inver Former, Venti Former, and inclined Delta Former machines. Preferably, an inclined Delta Former machine is utilized. A multicomponent mat of the invention can be prepared by forming natural fiber and glass fiber slurries and combining the slurries in mixing tanks, for example. The amount of water used in the process may vary depending upon the size of the equipment used. Typical volumes of water range from about 300,000 liters to about 1,850,000 liters. The thick stock may be delivered into a silo where the thick stock is diluted to form a thin stock or furnish. The furnish may be passed into a conventional head box where it is dewatered and deposited onto a moving wire screen where it is dewatered by suction or vacuum to form a non-woven multicomponent web. The web can then be coated with a binder by conventional means, e.g., by a flood and extract method and passed through a drying oven which dries the mat and cures the binder. The resulting mat may be collected in a large roll.

The foregoing detailed description has been given for clearness of understanding only and no unnecessary limitations should be understood therefrom as modifications will be obvious to those skilled in the art.

While the invention has been described in connection with specific embodiments thereof, it will be understood that it is capable of further modifications and this application is intended to cover any variations, uses, or adaptations of the invention following, in general, the principles of the invention and including such departures from the present disclosure as come with known or customary practice within the art to which the invention pertains and as may be applied to the essential features hereinbefore set forth and as follows in scope of the appended claims.

The invention will be described in greater detail in the following examples wherein there are disclosed various embodiments of the present invention for purposes of illustration, but not for purposes of limitation of the broader aspects of the present inventive concept.

EXAMPLES 1–18

In Examples 1–18, multicomponent handsheets of glass and natural fibers having dimensions of about 12 inches×12 inches were formed. The handsheets had a thickness (not including the thickness of a binder layer if provided) of between about 0.015 inch and 0.035 inch. The handsheets in Examples 1–18 resulted from benchtop experiments. A photocopy of a section of each resultant handsheet is set out in FIGS. 1–18. A conventional office-photocopy machine was used to generate the photocopies, i.e., the mats were placed on the glass-scanning surface of a photocopying machine to generate the photocopies.

Initially, Kenaf fibers, purchased form Kenaf Industries of Raymondville, Tex., were pretreated as the fibers were of poor quality, i.e., the fibers had an unacceptable amount of core and skin components. Two separate pretreatment processes were used, Pretreatment Process D and Pretreatment Process A.

Pretreatment Process D

Pretreatment Process D involved filling a hydropulper with 20 gallons of water and 12 milliliters (mL) of Nalco 7530 (obtained from Nalco, Naperville, Ill.). The contents in the hydropulper were mixed for about 30 seconds. Then, 800 grams of kenaf fiber (previously chopped to lengths of about 1 inch using a portable chopper) were added to the hydropulper and pulped for 60 minutes. Subsequently, the slurry was filtered and the natural fibers were collected on a screen. The collected fibers were washed several times using water and core and skin components were manually removed. Thereafter, the wet fibers were pressed to squeeze off excess water, and left on a tabletop to air dry to a moisture content of about 15%. The pretreated natural fibers were labeled as "D fibers."

Pretreatment Process A

Pretreatment Process A involves the same steps as Pretreatment D except Nalco 7530 was not added. Fibers pretreated using Pretreatment Process A were labeled "A Fibers."

Example 1

A natural fiber slurry was first prepared in a small food blender. 200 mL of city water, 2.1 grams of "D Fibers" having a moisture content of about 15%, and 10 drops of Nalco 7530 were added to the food blender. The contents were mixed (blended) at a medium speed for about 2 minutes. The natural fiber slurry was then ready for use.

A glass fiber slurry was prepared in a stainless steel container. The glass fibers used were purchased from Owens Coming under the product designation "OC 9502 Wet Use Chopped Strands." The fibers had a diameter of about 16 microns and a length of about 1 inch. Immediately after the glass fiber slurry was formed, the natural fiber slurry was combined with the glass fiber slurry.

To form the glass fiber slurry, 5 liters of water, and 12 drops of a cocamidopropyl hydroxysultaine, functioning as a dispersant, and acquired from Rhone Poulenc under the product designation "Mirataine CBS" were added to the container. Agitation and a timer were then initiated. At about 10 seconds after the start of the timer, about 5.5 grams of the OC 9502 1-inch fibers were added to the container under agitation. At about 1 minute after the start of the timer, about 150 mL of pre-diluted Nalco 7768 (about 0.5% by weight Nalco 7768 and 99.5% by weight water), obtained from Nalco Company, Naperville, Ill., and serving as a viscosity modifier, were added to the container under agitation. The glass fiber slurry was then ready to receive the natural fiber slurry.

At about 2 minutes after the start of the timer, the natural fiber slurry was added to the container under agitation. Agitation of the contents continued for about 12 minutes after the start of the timer. The mixed glass and natural fiber slurry was then ready for use in making a handsheet.

Prior to forming a handsheet, a deckle box was filled with about 35 liters of water and about 60 mL of pre-diluted Nalco 7768 (about 0.5% by weight Nalco 7768 and 99.5% by weight water). The contents in the deckle box were slightly mixed using a conventional mixing element. The glass and natural fiber slurry was then poured into the deckle box. To effect mixture of the contents now in the deckle box, the contents were stroked about 5 times using a conventional mixing element. Water was then drained from the deckle box and the remaining fibers were collected on a screen to form a handsheet. The resultant glass and natural fiber handsheet had sufficient structural integrity and strength such that the fibers remained joined together after the handsheet was removed from the deckle box even though no binder was used. A photocopy of a section of the handsheet is set out in FIG. 1.

Example 2

A handsheet was formed using the same process set out in Example 1 except that 2.1 grams of "A Fibers" were used in forming the natural fiber slurry. The resultant glass and natural fiber handsheet had sufficient structural integrity and strength such that the fibers remained joined together after the handsheet was removed from the deckle box even though no binder was used. A photocopy of a section of the handsheet is set out in FIG. 2.

Example 3

A handsheet was formed using the same process set out in Example 1 except that 2.1 grams of "A Fibers" were used in forming the natural fiber slurry. Further, no amount of Nalco 7530 was added to the natural fiber slurry. The resultant glass and natural fiber handsheet had sufficient structural integrity and strength such that the fibers remained joined together after the handsheet was removed from the deckle box even though no binder was used. A photocopy of a section of the handsheet is set out in FIG. 3.

Example 4

A handsheet was formed using the same process set out in Example 1 except that 4.0 grams (instead of 2.1 grams) of "D Fibers" were used in forming the natural fiber slurry, and 3.0 grams (instead of 5.5 grams) of glass fibers were used in forming the glass fiber slurry. Further, the 10 drops of Nalco 7530 were not added to the natural fiber slurry. However, 12 mL of Nalco 7530 were still used in the pretreatment process. The resultant glass and natural fiber handsheet had sufficient structural integrity and strength such that the fibers remained joined together after the handsheet was removed from the deckle box even though no binder was used. A photocopy of a section of the handsheet is set out in FIG. 4.

Example 5

A handsheet was formed using the same process set out in Example 1 except that 0.5 grams (instead of 2.1 grams) of "D Fibers" were used in forming the natural fiber slurry, and 6.5 grams (instead of 5.5 grams) of glass fibers were used in forming the glass fiber slurry. Further, the 10 drops of Nalco 7530 were not added to the natural fiber slurry. However, 12 mL of Nalco 7530 were still used in the pretreatment process. A photocopy of a section of the handsheet is set out in FIG. 5.

Example 6

A handsheet was formed using the same process set out in Example 1 except that 6.0 grams (instead of 2.1 grams) of "D Fibers" were used in forming the natural fiber slurry and 1.0 gram (instead of 5.5 grams) of glass fibers were used in forming the glass fiber slurry. Further, the 10 drops of Nalco 7530 were not added to the natural fiber slurry. However, 12 mL of Nalco 7530 were still used in the pretreatment process. The resultant glass and natural fiber handsheet had sufficient structural integrity and strength such that the fibers remained joined together after the handsheet was removed from the deckle box even though no binder was used. A photocopy of a section of the handsheet is set out in FIG. 6.

Example 7

Different Dispersant

A handsheet was formed using the same process set out in Example 1 except that 12 drops of Rhodameen VP-532/SPB, acquired from Rhone-Poulenc, were used as the dispersant (instead of Mirataine CBS) in the glass fiber slurry. The resultant glass and natural fiber handsheet had sufficient structural integrity and strength such that the fibers remained joined together after the handsheet was removed from the deckle box even though no binder was used. A photocopy of a section of the handsheet is set out in FIG. 7.

Example 8

Single Component Handsheet

A handsheet was formed using the same process set out in Example 1 except that 7.0 grams (instead of 2.1 grams) of "D Fibers" were used in forming the natural fiber slurry and 0.0 grams (instead of 5.5 grams) of glass fibers were used in forming the glass fiber slurry. Further, the 10 drops of Nalco 7530 were not added to the natural fiber slurry. However, 12 ml of Nalco 7530 were still used in the pretreatment process. The resultant natural fiber handsheet (it included no glass fibers) had sufficient structural integrity and strength such that the fibers remained joined together after the handsheet was removed from the deckle box even though no binder was used. A photocopy of a section of the handsheet is set out in FIG. 8.

Example 9

½ Inch Kenaf Fiber

A handsheet was formed using the same process set out in Example 2 except that 3.0 grams of ½ inch long "A Fibers" (instead of 2.1 grams of 1 inch "A Fibers") were used in the natural fiber slurry, and 5.0 grams (instead of 5.5 grams) of OC 9502 glass fibers were used in the glass fiber slurry. The resultant glass and natural fiber handsheet had sufficient structural integrity and strength such that the fibers remained joined together after the handsheet was removed from the deckle box even though no binder was used. A photocopy of a section of the handsheet is set out in FIG. 9.

Example 10

11 Micron, ¼ Inch Glass Fibers

A handsheet was formed using the same process set out in Example 2 except that 5.5 grams of glass fibers having a diameter of 16 microns and a length of about ¼ inch were used. Such fibers are commercially available from Owens Coming under the product designation "OC 776B WUCS." A photocopy of a section of the handsheet is set out in FIG. 10.

Example 11

1¼ Inch Glass Fibers

A handsheet was formed using the same process set out in Example 2 except that 5.5 grams of glass fibers having a diameter of 16 microns and a length of about 1¼ inches were used. Such fibers are commercially available from Owens Corning under the product designation "OC 9502 WUCS." The resultant glass and natural fiber handsheet had sufficient structural integrity and strength such that the fibers remained joined together after the handsheet was removed from the deckle box even though no binder was used. A photocopy of a section of the handsheet is set out in FIG. 11.

Example 12

With a Binder

A handsheet was formed using the same process set out in Example 1. Thereafter, a binder mixture comprising about 95% by weight urea formaldehyde (obtained from Borden Chemical, Inc. of Columbus, Ohio under the product designation "Bordon 485") and about 5% by weight styrene butadiene latex (obtained form Dow Chemical under the product designation "490NA") was impregnated into the handsheet. Excess binder was removed via vacuum. The coated handsheet was then dried and cured in a convection oven at 175° C. for 15 minutes. A photocopy of a section of the handsheet after application of the binder is set out in FIG. 12.

Example 13

With a Binder

Figure 13:
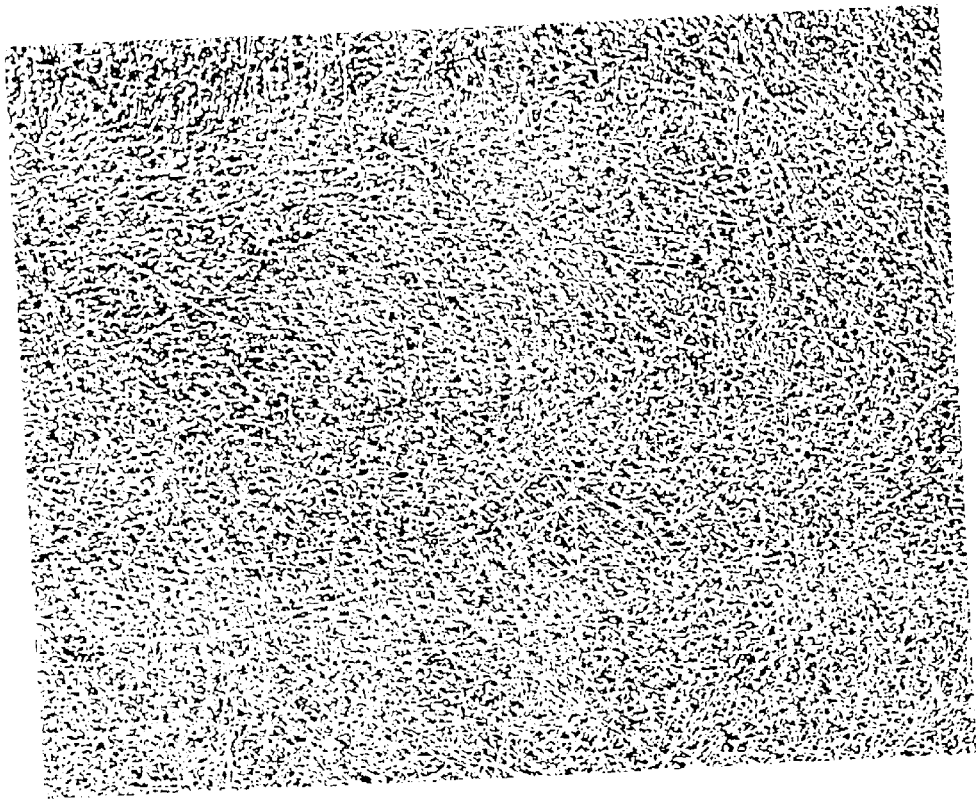
FIG. 13 is a photocopy of a mat produced in Example 13.

A handsheet was formed using the same process set out in Example 1 except that the glass fibers, commercially available from Owens Corning under the product designation "OC 9501 WUCS" (having a different sizing chemistry), were used. The binder mixture set out in Example 12 was impregnated into the handsheet. The coated handsheet was then dried and cured in a convection oven at 175° C. for 15 minutes. A photocopy of a section of the resultant handsheet after application of the binder is shown in FIG. 13.

Example 14

Bicomponent Handsheet of Sisal and Glass Fibers

A natural fiber slurry was first prepared in a small food blender. 200 mL of city water and about 2.1 grams of sisal fibers were added to the blender. The sisal fibers had a moisture content of about 3%. Furthermore, the sisal fibers were prechopped to lengths of about 1.5 inches. The contents in the blender were mixed (blended) at a medium speed for about 2 minutes. The natural fiber slurry was then ready for use.

Figure 14:
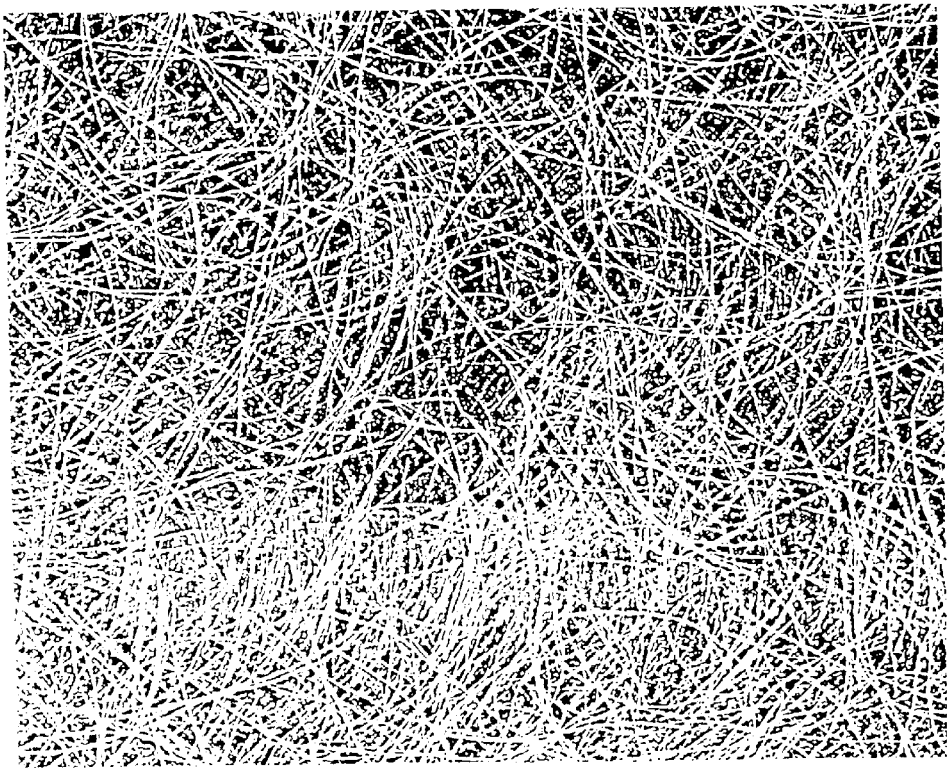
FIG. 14 is a photocopy of a mat produced in Example 14.

A glass fiber slurry was formed using the same process set out in Example 1 except that 5.0 grams (instead of 5.5 grams) of glass fibers were used in forming the glass fiber slurry. The sisal fiber slurry was then combined with the glass fiber slurry and a handsheet was formed from the combined slurry using the deckle box process set out in Example 1. A photocopy of a section of the resultant handsheet is shown in FIG. 14.

Example 15

Bicomponent Handsheet of Sisal and Glass Fibers

Figure 15:
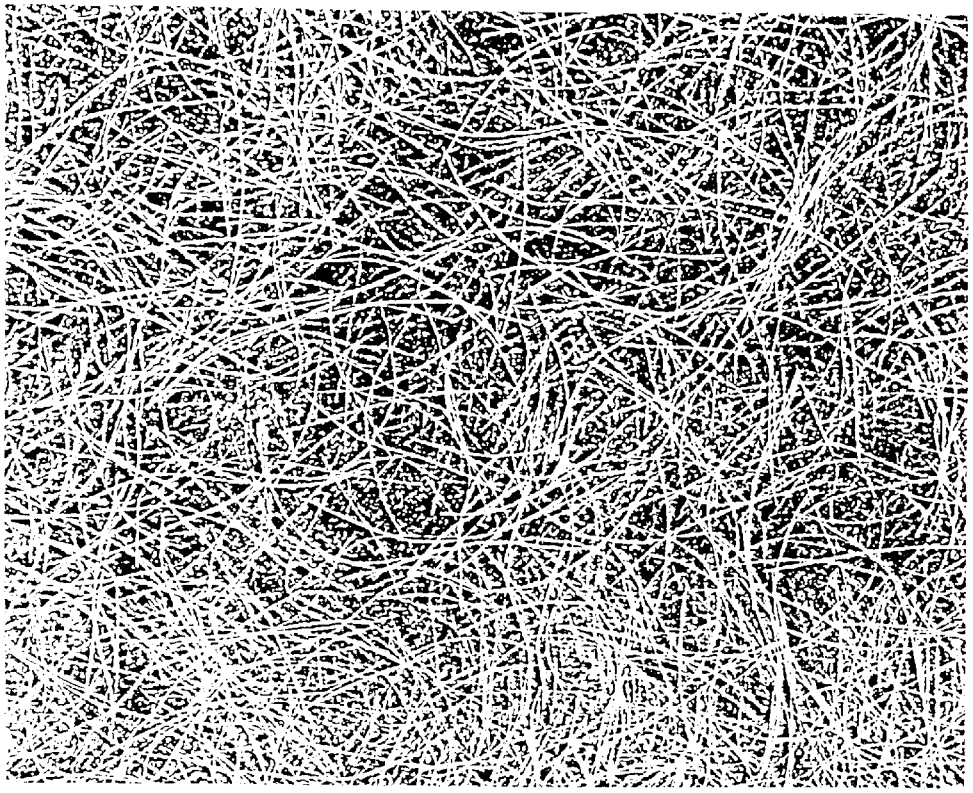
FIG. 15 is a photocopy of a mat produced in Example 15.

A handsheet was formed using the same process set out in Example 14 except that the sisal fibers were prechopped to a lengths of about 1 inch. A photocopy of a section of the resultant handsheet is shown in FIG. 15.

Example 16

Bicomponent Handsheet of Sisal and Glass Fibers

Figure 16:
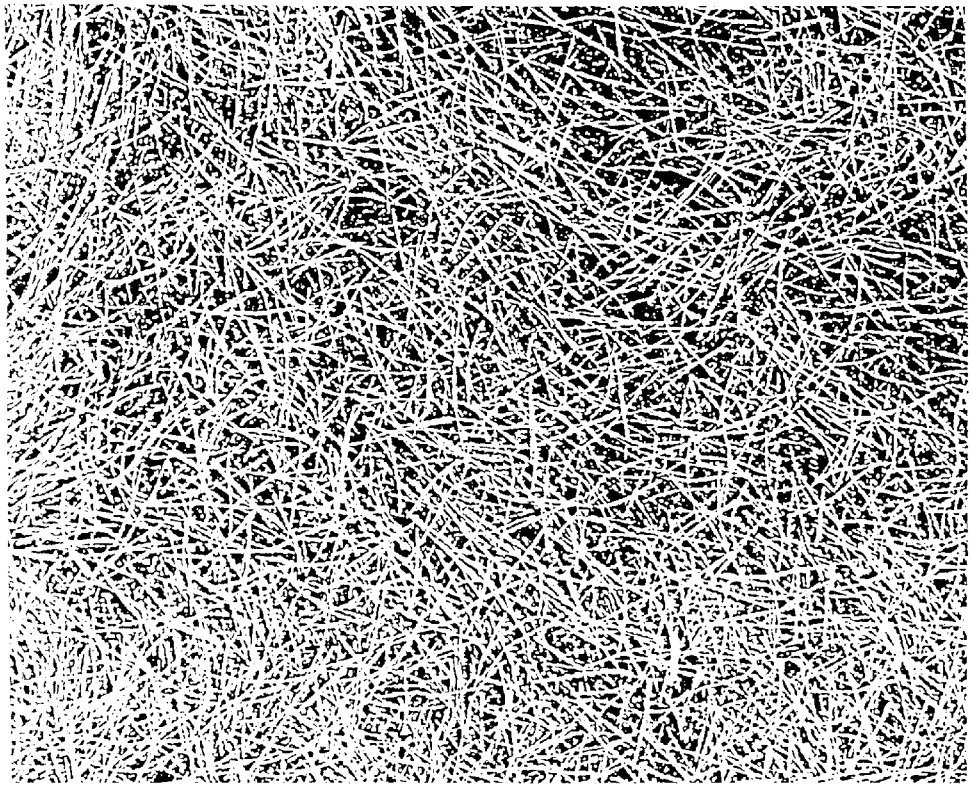
FIG. 16 is a photocopy of a mat produced in Example 16.

A handsheet was formed using the same process set out in Example 15 except that the sisal fibers were prechopped to lengths of about 0.5 inch, and 3.0 grams (rather than 2.1 grams) of sisal fibers were used in forming the natural fiber slurry. Further, 4.0 grams (instead of 5.0 grams) of OC 9502 glass fibers were used in the glass fiber slurry. A photocopy of a section of the resultant handsheet is shown in FIG. 16.

Example 17

Tricomponent Handsheet of Glass, Kenaf and Sisal Fibers and Binder Coating

A natural fiber slurry was first prepared in a small food blender. 200 mL of city water, 2.0 grams of "A Fibers" having a moisture content of about 15% by weight and 2.0 grams of sisal fibers having a moisture content of about 3% by weight and prechopped to lengths of about ¼ inch, were added to a food blender. The contents were mixed (blended) at a medium speed for 2 minutes. The natural fiber slurry was then ready for use.

A glass fiber slurry was formed using the same process set out in Example 1 except that 3.0 grams (instead of 5.5 grams) of glass fibers were used in forming the glass fiber slurry. The sisal and kenaf fiber slurry was then combined with the glass fiber slurry and a handsheet was formed from the combined slurry using the deckle box process set out in Example 1.

Figure 17:
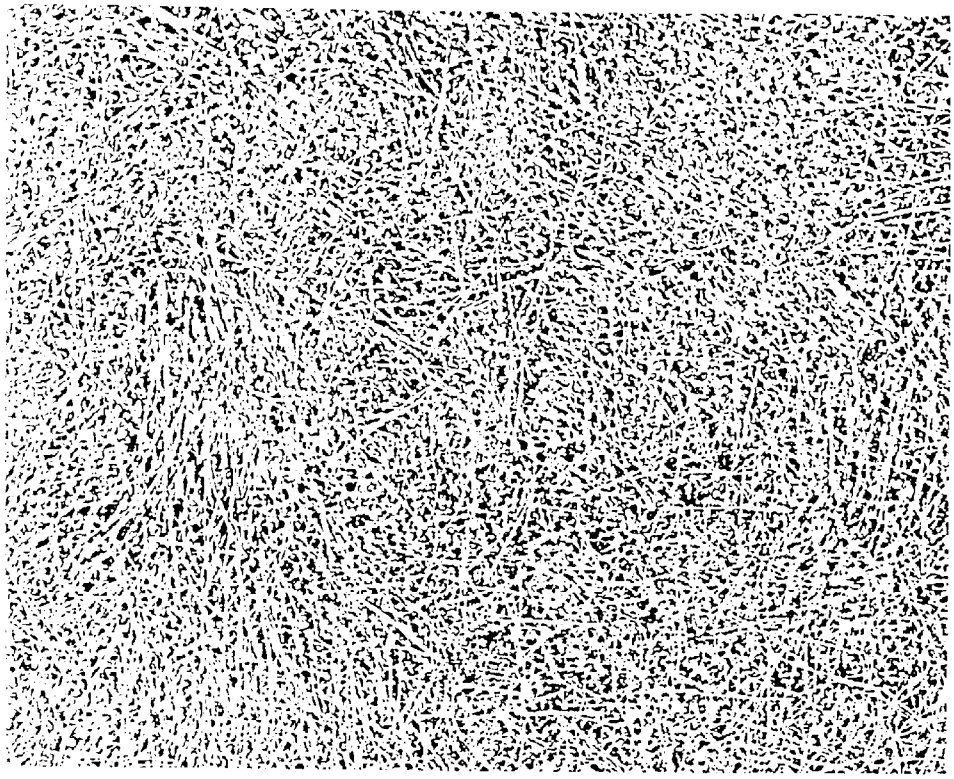
FIG. 17 is a photocopy of a mat produced in Example 17.

After the handsheet was formed, a binder mixture comprising about 95% by weight urea formaldehyde (obtained from Borden Chemical, Inc.) and about 5% by weight styrene butadiene latex (obtained form Dow Chemical) was impregnated into the handsheet. Excess binder was removed via vacuum. The coated handsheet was then dried and cured in a convection oven at 175° C. for 15 minutes. A photocopy of a section of the handsheet is shown in FIG. 17.

Example 18

Tricomponent of Glass, Kenaf and Sisal Fibers with a Binder

A handsheet was formed using the same process set out in Example 17 except that the natural fiber slurry was made differently. It comprised 200 mL of city water, 2.0 grams of "A Fibers" having a moisture content of about 15% by weight, 2.0 grams of sisal fibers having a moisture content of about 3% by weight and prechopped to lengths of about ¼ inch, and about 10 drops of Nalco 7530. Those contents were added to a food blender and mixed (blended) at a medium speed for about 2 minutes. The natural fiber slurry was then ready for use.

A glass fiber slurry was formed using the same process set out in Example 17. The sisal and kenaf fiber slurry was then combined with the glass fiber slurry and a handsheet was formed from the combined slurry using the deckle box process set out in Example 1.

Figure 18:
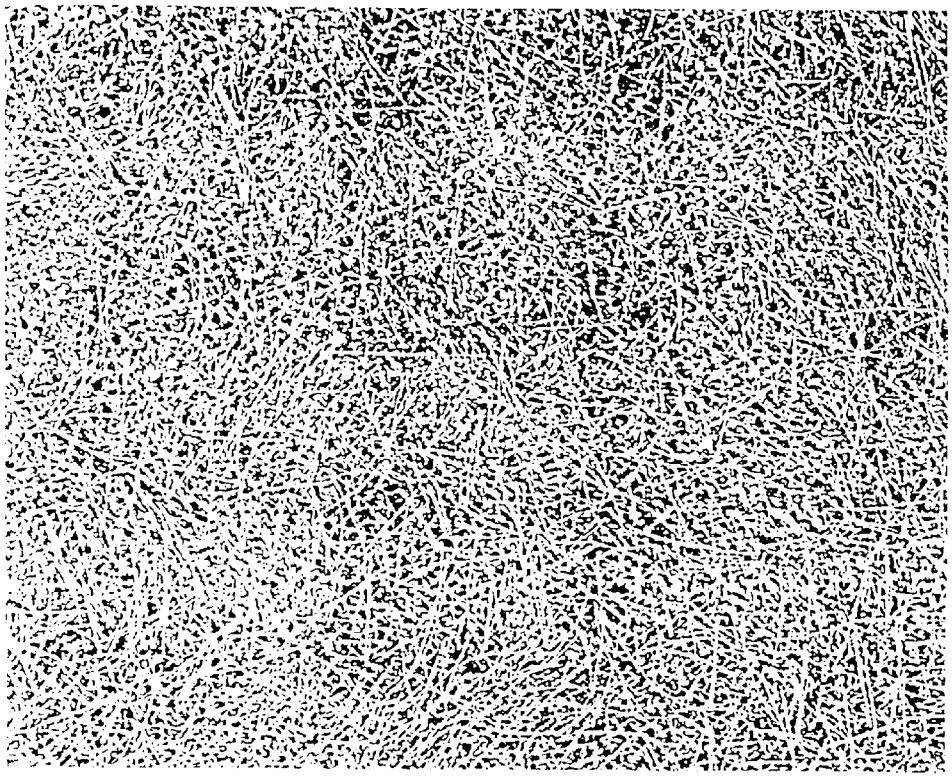
FIG. 18 is a photograph of a mat produced in Example 18.

The binder mixture set out in Example 17 was subsequently impregnated into the handsheet. The coated handsheet was then dried and cured in a convection oven at 175° C. for 15 minutes. A photocopy of a section of the resultant handsheet is shown in FIG. 18.

Examples 19–25

Initially, Kenaf fibers, purchased form Kenaf Industries of Raymondville, Tex., were pretreated as the fibers were of poor quality, i.e., the fibers had an unacceptable amount of core and skin components. Two separate pretreatment processes were used, Pretreatment Process D1 and Pretreatment Process A1.

Pretreatment Process D1

Pretreatment Process D1 involved filling a hydropulper with 30 gallons of water and 25 milliliters (mL) of Nalco 7530 (obtained from Nalco, Naperville, Ill.). The contents in the hydropulper were mixed for about 30 seconds. Then, 4 pounds of kenaf fiber (previously chopped to lengths of about 1 inch using a portable chopper) were added to the hydropulper and pulped for 70 minutes. Subsequently, the slurry was filtered and the natural fibers were collected on a screen. The collected fibers were washed several times using water and core and skin components were manually removed. Thereafter, the wet fibers were pressed to squeeze off excess water, and had a moisture content between about 60% and about 80%. The pretreated natural fibers were labeled as "D1 fibers."

Pretreatment Process A1

Pretreatment Process A1 involves the same steps as Pretreatment D1 except Nalco 7530 was not used. Fibers pretreated using Pretreatment Process A1 were labeled "A1 Fibers."

In each of Examples 19–25, the natural fibers had a length of about 1 inch; the glass fibers had a diameter of about 16 microns, a length of about 1 inch and were purchased from Owens Corning under the product designation "OC 9502 Wet Use Chopped Strands"; the dispersant used in the glass fiber slurry was Mirataine CBS; the viscosity modifier used in the glass fiber slurry was Nalco 7768; and, if a cationic polymer was provided in the natural fiber slurry, Nalco 7530 was used.

Preparation of White Water

White water was prepared by mixing 100 mL of Mirataine CBS and 600 mL Nalco 7768 with 1500 gallons of city water. This fresh white water was stored in a white water tank and aged for at least 24 hours before being used in a mat making process.

The continuous length mats of Examples 19–25 were made using a conventional 30-inch wide pilot scale wet process line under the conditions set out in Table 1.

added to the hydropulper. The contents were then mixed for 3 to 5 minutes in the hydropulper. A specified amount of Nalco 7530, as indicated in Table 1, was added in Examples 22–25 only.

The glass fiber slurry was prepared in a 500-gallon tank for each of Examples 19–25. About 400 gals of white water, mixed and aged as set out above, and an amount of dispersant, as specified in Table I, were added to and mixed in the tank. Then, a quantity of glass fibers, as specified in Table I, was added to the tank. A timer was also started when the glass fibers were added. At 3 minutes after the start of the timer, about 20 gallons of diluted viscosity modifier solution, comprising a mixture of 20 gallons of white water and an amount of Nalco 7768 (viscosity modifier), as specified in Table I, was pumped into the tank. The glass fiber slurry was then completed.

At about 5 minutes after the start of the timer, the prepared natural fiber slurry was added to the glass fiber slurry in the tank, Examples 21–25 only. Additional white water was added to the tank so that the combined volume of the mixture was 500 gallons. The contents of the 500-gallon tank were agitated for another 5 minutes before being ready for use in forming a mat. A small amount of an antifoam agent was also added if excess foam was observed.

When the mixed natural and glass fiber slurry was ready, it was pumped into a headbox where excess water was drained off by means of both gravity and vacuum, and the fibers were deposited on an endless moving screen. A continuous mat was formed on the moving screen at a given line speed. The wet mat then passed under a flood-and-extract curtain coater where it was coated with an aqueous binder. The excess binder was removed by vacuum. Thereafter, the coated mat was dried and the binder cured in a oven. The dried mat was wound up into a roll.

The mats of Examples 19 and 20 did not contain any natural fibers and were control examples to which the remaining mats of Examples 21–25 were compared. In Example 21, the natural fiber slurry contained only 900 grams of wet natural fibers and contained no amount of Nalco 7530. The glass fiber slurry in Example 21 contained only 30 mL of dispersant and 20 mL of viscosity modifier.

TABLE 1

Pilot Wet Process Line Parameters for Example 19 to 25.
Nalco 7768, 600 mL
CBS, 100 mL
Dispersant = Mirataine CBS; Viscosity Modifier = Nalco 7768

| | Run # | Glass gram (wet) | Natural Fibers type | Natural Fibers grams (wet) | Dispersant mL | Viscosity modifier mL | Nalco 7530 mL in N.F. Slurry | MAT Composition glass/N.F./Binder | Final Note |
|---|---|---|---|---|---|---|---|---|---|
| Example 19 | 00-5-1 | 6500 | None | 0 | 20 | 20 | none | 80.5/0.0/18.5 | Control |
| Example 20 | 00-5-2 | 6500 | None | 0 | 20 | 20 | none | 80.9/0.0/19.1 | Control |
| Example 21 | 00-5-3 | 6130 | A1 | 900 | 30 | 20 | none | 78.0/3.7/18.3 | |
| Example 22 | 00-5-9 | 5850 | A1 | 1260 | 80 | 100 | 300 | 78.0/5.1/16.9 | |
| Example 23 | 00-5-10 | 5850 | D1 | 1260 | 80 | 100 | 300 | 78.1/4.9/17.0 | |
| Example 24 | 00-5-12 | 5200 | A1 | 3800 | 80 | 100 | 300 | 72.4/9.8/17.8 | |
| Example 25 | 00-5-17 | 4680 | D1 | 11000 | 80 | 100 | 400 | 73.1/26.9/0.0 | No binder |

For Examples 21–25, a natural fiber slurry was prepared by adding natural fibers, in an amount specified in Table I, and about 25 gallons of white water to a hydropulper. "Wet" in Table 1 indicates that the natural fibers had a moisture content of from about 60% to about 80% prior to being The glass fiber slurries in Examples 22–25 contained 80 mL of dispersant and 100 mL of viscosity modifier. The mat of Example 25 did not receive a binder coating. However, the multicomponent mat of Example 25 had sufficient strength that it could be wound into a roll.

TABLE 2

Mat Property (raw data) for Examples 19 to 24.

| | SAMPLE Number | Basis Weight | MD Tensile (lbs/2 in) | CMD Tensile (lbs/2 in) | MD Elmundorf Tear grams | CMD Elmundorf Tear grams | Total tensile | Total tear | Ignition Loss % |
|---|---|---|---|---|---|---|---|---|---|
| Example 19 | 00-5-1 | 0.019 | 67.2 | 56.8 | 419.9 | 467.9 | 124.0 | 887.7 | 18.5 |
| Example 20 | 00-5-2 | 0.019 | 66.2 | 53.2 | 375.3 | 469.7 | 119.4 | 845.1 | 19.1 |
| Example 21 | 00-5-3 | 0.017 | 49.7 | 39.7 | 381.9 | 398.3 | 89.4 | 780.1 | 22.0 |
| Example 22 | 00-5-9 | 0.016 | 61.7 | 41.2 | 462.4 | 348.3 | 102.9 | 810.7 | 22.0 |
| Example 23 | 00-5-10 | 0.016 | 69.9 | 47.0 | 326.0 | 415.1 | 116.8 | 741.1 | 21.9 |
| Example 24 | 00-5-12 | 0.014 | 50.8 | 32.8 | 311.5 | 421.9 | 83.6 | 733.3 | 27.6 Binder + Natural Fiber |

TABLE 3

CORRECTED MAT PROPERTY
(corrected for the mat basis weight only,
with a reference basis weight = 0.017 pounds/sq ft)

| | SAMPLE Number | Basis Weight | MD Tensile (lbs/2 in) | CMD Tensile (lbs/2 in) | MD Elmundorf Tear grams | CMD Elmundorf Tear grams | Total tensile | Total tear |
|---|---|---|---|---|---|---|---|---|
| Example 19 | 00-5-1 | 0.019 | 60.1 | 50.8 | 375.7 | 418.6 | 110.9 | 794.3 |
| Example 20 | 00-5-2 | 0.019 | 59.2 | 47.6 | 335.8 | 420.3 | 106.8 | 756.1 |
| Example 21 | 00-5-3 | 0.017 | 49.7 | 39.7 | 381.9 | 398.3 | 89.4 | 780.1 |
| Example 22 | 00-5-9 | 0.016 | 65.6 | 43.7 | 491.3 | 370.0 | 109.3 | 861.3 |
| Example 23 | 00-5-10 | 0.016 | 74.2 | 49.9 | 346.4 | 441.0 | 124.1 | 787.4 |
| Example 24 | 00-5-12 | 0.014 | 61.7 | 39.8 | 378.2 | 512.3 | 101.5 | 890.5 |

Mat property data for the mats of Examples 19–24 are set out above in Tables 2 and 3. The basis weight is in units of pounds/ft$^2$. "MD Tensile" designates the tensile strength of a 2-inch strip cut from the corresponding mat in the machine direction of the mat, i.e., the strip had a longitudinal axis extending parallel to the machine direction of the mat. "CMD Tensile" designates the tensile strength of a 2-inch strip cut from the corresponding mat in a cross machine direction of the mat, i.e., the strip's longitudinal axis ran 90° to the machine direction of the mat. "MD Elmundorf Tear" is the tear strength of a 2-inch strip cut from the corresponding mat having a longitudinal axis extending parallel to the machine direction of the mat. "CMD Elmundorf Tear" is the tear strength of a 2-inch strip cut from the corresponding mat having a longitudinal axis extending 90° to the machine direction of the mat. "Total Tensile" is the summation of "MD Tensile" and "CMD Tensile." "Total Tear" is the sunnmation of "MD Elmundorf Tear" and "CMD Elmundorf Tear."

In Table 3, the data was corrected for mat basis weight only, such that all data for each example was adjusted to correspond to a reference basis weight of 0.017 pounds/ft$^2$. As is apparent from Table 3, the total tear strength for each of the mats of Examples 22 and 24 was greater than the corresponding total tear strength of the mats of control Examples 19 and 20. Hence, the tear strength of the mats of Examples 22 and 24, which mats included both glass and natural fibers, exceeded that of the control mats, which included only glass fibers.

Examples 26–31

Examples 26–31 are directed to asphalt shingles. The mats set out in Examples 19–24 were used in the forming processes of the shingles of Examples 26–31 respectively.

All of the asphalt shingles of Examples 26–31 were made under similar conditions. Initially, the mats of Examples 19 to 24 were slit into 12-inch wide sections. During separate passes through a conventional lab-made asphalt coater, those sections were coated on opposing sides with a calcite filled hot asphalt. The asphalt was acquired from Owens Corning, under the product designation "SU#7696-01." The calcite was acquired from Imery's Pigments and Additives, Roswell Ga. The calcite filled asphalt comprised by weight 65% calcite and 35% asphalt.

Prior to the strip passing through the coater, the filled asphalt was preheated to a temperature of about 425° F. A doctor blade, incorporated into the coater, was used to control the coating thickness. It was set at 0.065 inch relative to a datum such that all six samples received a coating and the combined thickness of the sample and the coating was 0.065 inch. After the first pass through the coater, the coated side of the strip was dusted with sand. Then, the asphalt coating was allowed to cool as the strip moved through cold rollers. Subsequently, the strip was wound up into a roll.

During the second pass through the coater, the asphalt was coated on a second side of the mat, then dusted with sand. The parameters in the second pass were exactly the same as in the first pass, except that the doctor blade was set at 0.095 inch from the datum such that the strip received a coating and the combined thickness of the strip and the two coatings was 0.095 inch.

TABLE 4

Shingle Property (Raw data) For Examples 26 to 31.

| | Mat # Used in Shingle | Mat Basis Weight | MD Tensile Pounds | MD Elmundorf Tear grams | CMD Elmundorf Tear grams | Total Tear Grams |
|---|---|---|---|---|---|---|
| Example 26 | 00-5-1 | 0.019 | 208.3 | 1693.4 | 1963.9 | 3657.3 |
| Example 27 | 00-5-2 | 0.019 | 192.2 | 1643.9 | 1936.3 | 3580.2 |
| Example 28 | 00-5-3 | 0.017 | 155.5 | 1900.0 | 2113.4 | 4013.4 |
| Example 29 | 00-5-9 | 0.016 | 172.5 | 1680.1 | 2281.5 | 3961.6 |
| Example 30 | 00-5-10 | 0.016 | 182.1 | 1699.3 | 2304.3 | 4003.6 |
| Example 31 | 00-5-12 | 0.014 | 149.9 | 1788.7 | 1823.1 | 3611.8 |

TABLE 5

CORRECTED SHINGLE PROPERTY
(corrected for the mat basis weight only, with a reference basis weight = 0.017 pounds/sq ft)

| | Mat # Used in Shingle | Mat Basis Weight | MD Tensile Pounds | MD Elmundorf Tear grams | CMD Elmundorf Tear grams | Total Tear Grams |
|---|---|---|---|---|---|---|
| Example 26 | 00-5-1 | 0.019 | 190.4 | 1547.7 | 1795.0 | 3342.7 |
| Example 27 | 00-5-2 | 0.019 | 176.6 | 1510.6 | 1779.3 | 3289.9 |
| Example 28 | 00-5-3 | 0.017 | 157.4 | 1922.6 | 2138.6 | 4061.2 |
| Example 29 | 00-5-9 | 0.016 | 183.3 | 1785.1 | 2424.1 | 4209.2 |
| Example 30 | 00-5-10 | 0.016 | 198.4 | 1851.8 | 2511.1 | 4362.9 |
| Example 31 | 00-5-12 | 0.014 | 175.7 | 2097.1 | 2137.4 | 4234.5 |

Shingle property data for the shingles of Examples 26–31 are set out in Tables 4 and 5. The basis weight is in units of pounds/ft$^2$. "MD Tensile" designates the tensile strength of a 2-inch strip cut from the corresponding shingle in the longitudinal direction of the shingle, i.e., the strip had a longitudinal axis extending parallel to the longitudinal axis of the shingle. "MD Elmundorf Tear" is the tear strength of a 2-inch strip cut from the corresponding shingle and having a longitudinal axis extending parallel to the longitudinal axis of the shingle. "CMD Elmundorf Tear" is the tear strength of a 2-inch strip cut from the corresponding shingle and having a longitudinal axis extending 90° to the longitudinal axis of the shingle. "Total Tear" is the summation of "MD Elmundorf Tear" and "CMD Elmundorf Tear."

In Table 5, the data was corrected for mat basis weight only, such that all data for each example was adjusted to correspond to a reference basis weight of 0.017 pounds/ft$^2$. As is apparent from Table 5, the total tear strength for each shingle of Examples 28–31 was greater than the corresponding total tear strength of the shingles of control Examples 26 and 27. Hence, the tear strength of the shingles of Examples 28–31, which shingles included both glass and natural fibers, exceeded that of the control shingles, which included only glass fibers.

What is claimed is:

1. A method of making a multicomponent mat of glass fibers and natural fibers comprising the steps of:

(a) forming a natural fiber slurry by mixing together natural fibers having a length between about 5 mm and 51 mm and water, said natural fibers comprising at least one of kenaf fibers, sisal fibers, flax and hemp;

(b) forming a glass fiber slurry;

(c) combining and mixing the natural fiber slurry and the glass fiber slurry;

(d) forming a wet mat from the combined natural fiber and glass slurries; and (e) removing any excess moisture.

2. The method of claim 1, wherein the natural fiber slurry is formed including a cationic polymer.

3. The method of claim 2, wherein the cationic polymer comprises an acrylamide modified cationic polymer.

4. The method of claim 1, wherein the step of forming a glass fiber slurry comprises the step of mixing together a dispersant, water, glass fibers, and a viscosity modifier.

5. The method of claim 4, wherein the viscosity modifier comprises a modified polyacrylamide.

6. The method of claim 4, wherein the surfactant comprises cocamidopropyl hydroxysultaine.

7. The method of claim 4, wherein the glass fibers have an average length of about 0.1 to about 1.5 inches.

8. The method of claim 4, wherein in the glass fiber slurry, the glass fibers are present in an amount of about 0.1 to about 3.0 weight percent of the glass fiber slurry.

9. The method of claim 1, further comprising the steps of applying a binder to the wet mat and curing the binder.

10. The method of claim 8 wherein the binder comprises a urea formaldehyde binder.

11. The method of claim 1, wherein the viscosity of the slurry mixture in step (c) is about 1.5 to about 6 centipoise.

12. A multicomponent mat formed by the method of claim 1.

13. The multicomponent mat of claim 12, wherein the glass fibers are present in the mat in an amount ranging from about 10 to about 90 weight percent.

14. The multicomponent mat of claim 12, wherein the natural fibers are present in the mat in an amount ranging from about 90 to about 10 weight percent.

15. The multicomponent mat of claim 12, wherein the mat further includes a binder which is present in the mat in an amount ranging from about 1 to about 30 weight percent.

16. The multicomponent mat of claim 12, wherein the glass fibers are present in the mat in an amount ranging from about 10 to about 90 weight percent, the natural fibers are present in an amount ranging from about 90 to about 10 weight percent.

17. A fiber slurry for making a multicomponent mat comprising:

(a) glass fibers having an average length of about 0.1 inch (2.54 mm) to about 1.5 inches (38.1 mm);

(b) natural fibers having a length between about 5 mm and 51 mm, said natural fibers comprising at least one of kenaf fibers, sisal fibers, flax and hemp; and (c) water.

18. The fiber slurry of claim 17, wherein the glass fibers are present in an amount of about 10 to about 90 weight percent of total solids and the natural fibers are present in the amount of about 90 to about 10 weight percent of total solids.

19. The fiber slurry of claim 17, further comprising (d) a dispersant; and (e) a viscosity modifier.

20. The fiber slurry of claim 19, wherein the viscosity modifier comprises a modified polyacrylamide.

21. A roofing shingle comprising:

a multicomponent mat formed by the process of: forming a natural fiber slurry by mixing together natural fibers having a length between about 5 mm and 51 mm and water, said natural fibers comprising at least one of kenaf fibers, sisal fibers, flax and hemp; forming a glass fiber slurry; combining and mixing the natural fiber slurry and the glass fiber slurry; forming a wet mat from the combined natural fiber and glass slurries; applying a binder to the wet mat; and removing any excess moisture and curing the binder; and an asphalt coating on at least one outer surface of the mat.

22. A method of making a multicomponent mat of glass fibers and natural fibers comprising the steps of:

(a) forming a natural fiber slurry by mixing together natural fibers having a length between about 6.4 mm and 51 mm and water;

(b) forming a glass fiber slurry;

(c) combining and mixing the natural fiber slurry and the glass fiber slurry;

(d) forming a wet mat from the combined natural fiber and glass slurries; and (e) removing any excess moisture.

23. The method of claim 22 wherein said natural fibers have a length between about 12.7 mm and 51 mm.

* * * * *